United States Patent [19]

Gilbert

[11] 4,201,330

[45] May 6, 1980

[54] HINGED COVER CONTAINER WITH HAND HOLE LOCK

[75] Inventor: Earl F. Gilbert, Farmington Hills, Mich.

[73] Assignee: Westvaco Corporation, New York, N.Y.

[21] Appl. No.: 29,251

[22] Filed: Apr. 11, 1979

[51] Int. Cl.[2] ..... B65D 5/00; B65D 5/22

[52] U.S. Cl. ..... 229/33

[58] Field of Search ..... 229/33, 36, 44, 45

[56] References Cited

U.S. PATENT DOCUMENTS

| | | | |
|---|---|---|---|
| 1,174,605 | 3/1916 | Palmer | 229/36 UX |
| 2,111,376 | 3/1938 | Vamwingen | 229/33 |
| 2,456,841 | 12/1948 | Rushing | 229/45 |
| 2,597,848 | 5/1952 | Reeser | 229/45 X |
| 2,660,363 | 11/1953 | Trickett, Jr. et al. | 229/35 |
| 2,839,236 | 6/1958 | Dumming | 229/33 X |
| 3,342,401 | 9/1967 | Kitchell | 229/45 X |
| 3,863,829 | 2/1975 | Merrill | 229/33 X |
| 3,933,300 | 1/1976 | Dempster | 229/36 X |
| 4,046,309 | 9/1977 | Poggiali | 229/36 X |

*Primary Examiner*—Davis T. Moorhead

[57] ABSTRACT

A hinged cover container with integral end cover flaps and handholes is provided with a locking means for securing the end cover flaps and hinged cover to the end walls of the container. When handholes are cut from the end cover flaps of the container, integral locking tongues are produced which are tucked into slits in the end walls of the container to secure the hinged cover to the container and prevent the contents from being spilled when the container is picked up.

6 Claims, 4 Drawing Figures

HINGED COVER CONTAINER WITH HAND HOLE LOCK

BACKGROUND OF INVENTION

The present invention relates generally to hinged cover containers and more particularly to an improved hand hole lock for a hinged cover container.

Containers having integral, hinged covers are not new, nor is the use of hand holes in containers a new concept. However, in general, when both hand holes and covers are provided for containers there is no working relationship between the two features. For instance, U.S. Pat. Nos. 2,216,299, 3,143,275, and 3,788,538, each illustrate containers having both handhole cut outs and hinged covers. However, in each case, the two items perform independently of one another except in the case of U.S. Pat. No. 2,216,299, where portions of two opposed top flaps cooperate with handhole flaps to distribute the load of the container. Meanwhile, U.S. Pat. Nos. 2,954,914 and 3,547,337 each show handhole cut outs applied to open top containers, and U.S. Pat. No. 2,768,778 illustrates handhole cut out flaps for securing a separate top to a container. Notwithstanding, the present invention incorporates handhole cut outs in the outer end cover flaps of a hinged cover container wherein the handhole flaps are folded and tucked into appropriate slots in the end walls of the container to secure the hinged cover in place. Thus, applicant has combined the best features of the prior art to perform a new and unexpected result.

SUMMARY OF INVENTION

The present invention relates to shipping containers, and more particularly to a shipping container that has an integral hinged cover and end cover flaps which contain handholes, and a means for using the handhole flaps to secure the integral hinged cover to the container. The invention is applicable to any style container that includes an integral hinged cover and end cover flaps that are arranged to fit outside of the nominal side and end walls of the container. With handhole cut outs applied to the outer end cover flaps of such a container, and with no independent means for securing the hinged cover and end cover flaps to the container, the contents tend to spill out when the container is picked up. However, in accordance with the present invention, the flaps which are produced when the handhole cut outs are made in the end cover flaps are tucked into slots provided therefor in the end walls of the container to secure the hinged cover in place.

In accordance with the present invention a blank of corrugated paperboard or the like is provided with suitable cuts and scores to produce a container having a bottom wall, a front wall, a rear wall, and preferably, multiple panel end walls. In addition, the blank includes an integral top cover panel with an attached front cover flap and one or more end cover flaps at each end. The multiple panel end walls are each provided with locking slots that become superimposed with one another when the panels are folded into their upright condition and at least the outer end cover flaps at each end of the container are provided with handhole cut outs to provide the locking flaps for the container. The arrangement described provides strengthened end walls to provide stacking strength, and also provides a means for uniformly distributing the load of the container along the end walls when the handhole locking flaps are inserted in their appropriate locking slots. Moreover, since the handhole locking flaps serve to retain the integral hinged cover panel in place, the contents of the container is protected from the elements and from direct contamination by other products stacked thereon.

The container of the present invention described in more detail hereinafter is shipped in blank form for assembly at the point of use where the end walls and end cover flaps are stapled together. However, the invention could readily be applied to collapsible shipping containers that are assembled without staples or the like using only frictional locks, thereby enabling the containers to be knocked down after one or more uses and reused when desired.

With the above and other objects in mind, the invention is more specifically described by reference to the following detailed description and the appended drawing.

DETAILED DESCRIPTION

Figure 1:
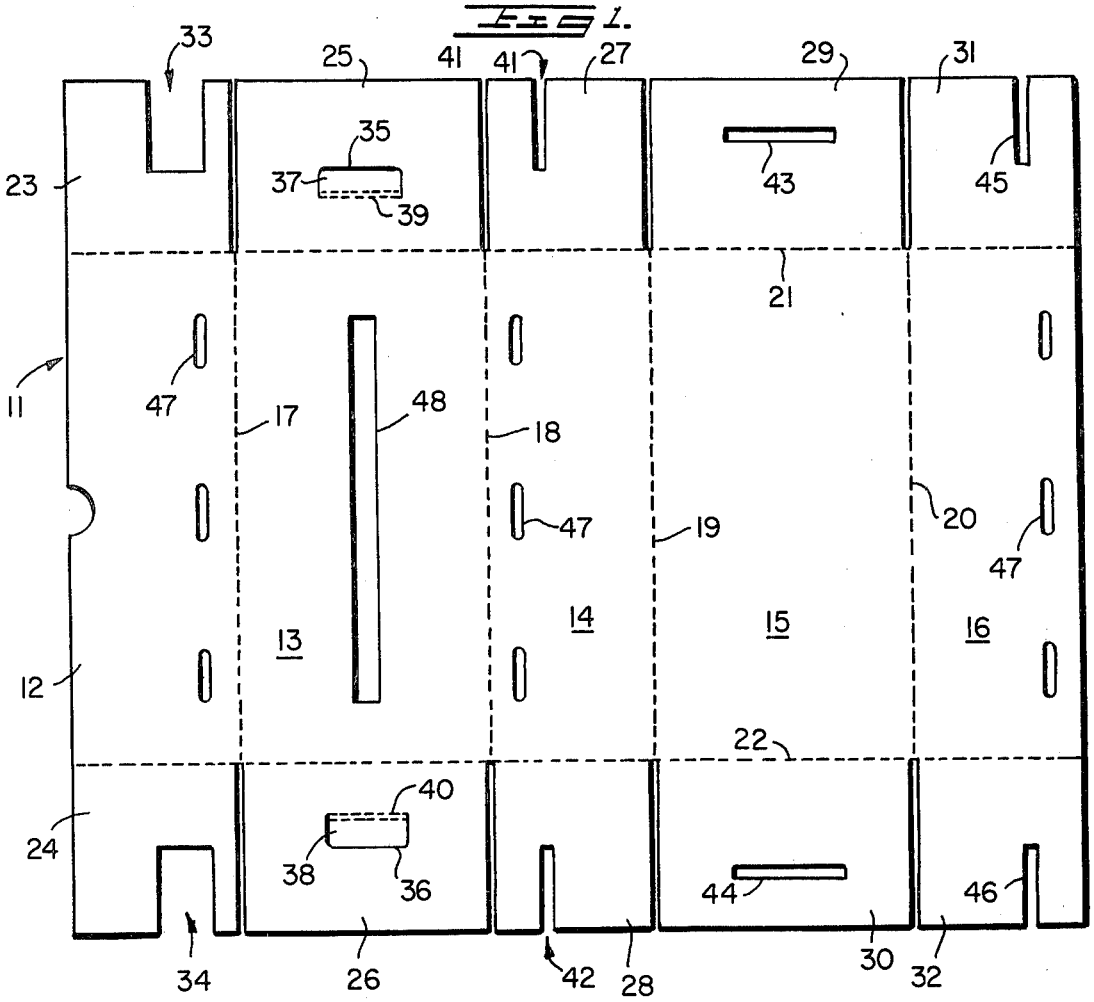
FIG. 1 is a plan view of a typical blank for constructing a container according to the present invention.
Figure 3:
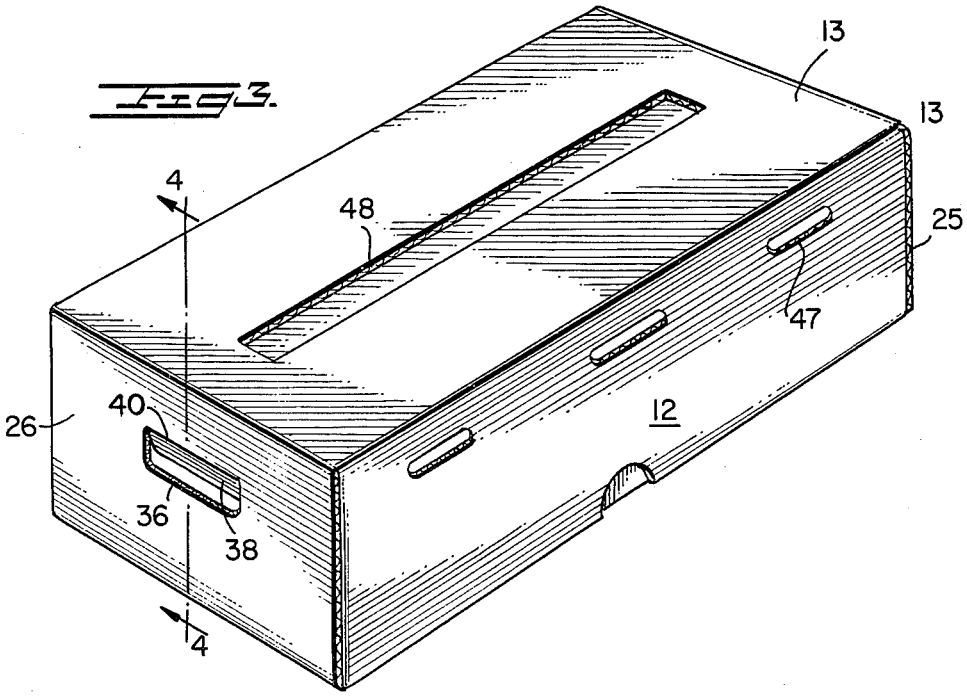
FIG. 3 is a view similar to FIG. 2 with the hinged cover closed and the handhole locks in place; and, FIG. 4 is an enlarged cross sectional view through the lines 4—4 of FIG. 3.
Figure 2:
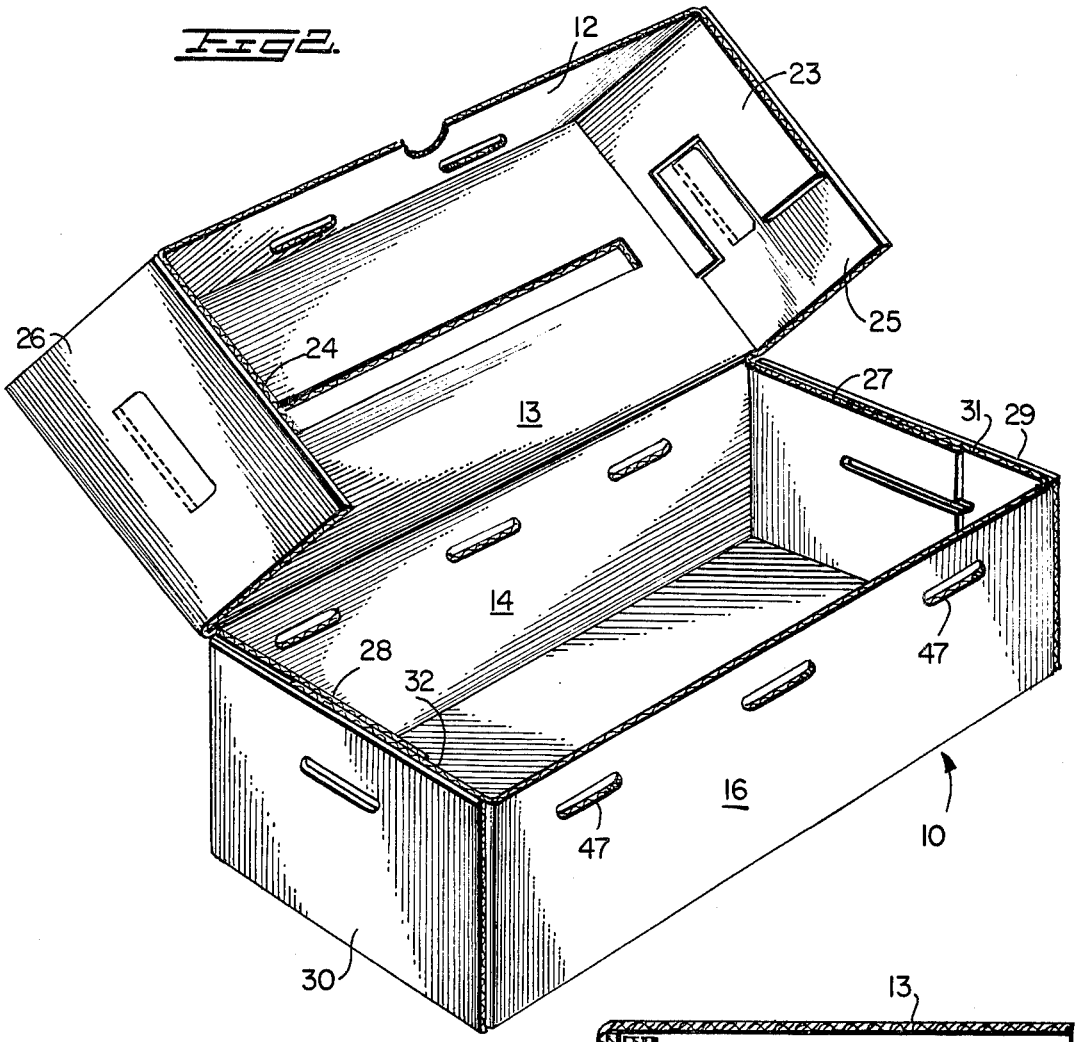
FIG. 2 is a perspective view of the container constructed from the blank of FIG. 1 with the hinged cover opened.
Figure 4:
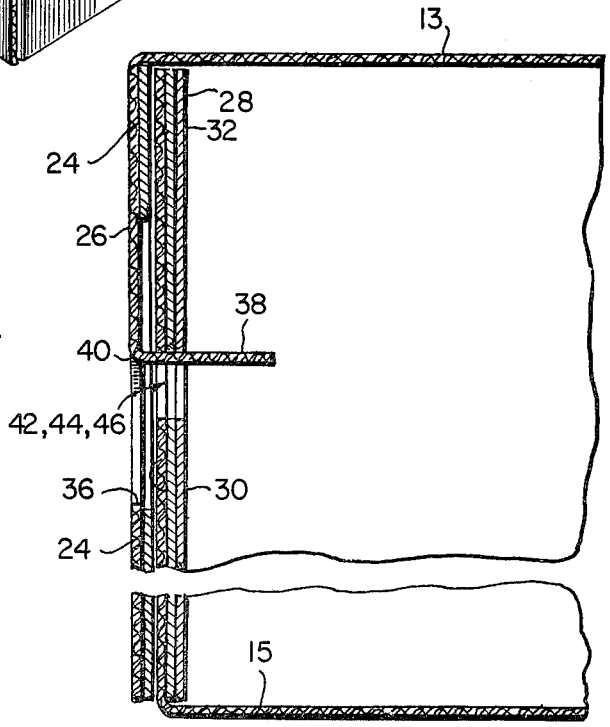

A container constructed in accordance with the present invention is illustrated in FIGS. 2–4 and is generally designated by the reference numeral 10. The container 10 is preferably constructed from corrugated paperboard or similar paper stock material by appropriately setting up the container blank 11 shown in FIG. 1.

The container blank 11 includes a front cover panel 12, a top cover wall 13, a rear wall 14, a bottom wall 15 and a front wall 16, each separated from the other by fold lines 17,18,19 and 20. Each of the primary walls are generally rectangular in configuration and are set off by a pair of longitudinal fold lines 21,22.

A first pair of end cover flaps 23,24 are foldably attached along the fold lines 21,22 to the front cover panel 12, and a second pair of end cover flaps 25,26 are foldably attached along the fold lines 21,22 to the top cover wall 13. Meanwhile, a plurality of end wall flaps 27,28, 29,30 and 31,32, are foldably attached to the walls 14,15 and 16 respectively, along the fold lines 21,22. The first end cover flaps 23,24 contain cut out areas 33,34 which serve when the container is set up to provide access for the handhole cutouts 35,36 in the second end cover flaps 25,26. Meanwhile, the handhole cut outs 35,36 form the locking tongues 37,38 for the container. Each of the locking tongues 37,38 are foldably attached to the second end cover flaps 25,26 by spaced fold lines 39,40. In like manner, each of the end wall flaps 27,28, 29,30, and 31,32, contain elongated slots 41,42, 43,44, and 45,46, respectively, which coincide with one another when the container is set up for use. Note that the slots 41,42 and 45,46 are applied at the edge of their respective flaps 27,28 and 31,32 only because the flaps are shorter in length than the end walls 29,30. Thus, while the flaps 27,29 and 31 and 28,30 and 32 overlap one another, the overlap is not complete. Also, as shown in FIG. 1, the front cover panel 12, rear wall 14 and front wall 16 each include slots 47 provided for ventilation of the contents. And, similarly, the top cover wall 13 includes an elongated slot 48, which provides a well ventilated container, and a means for viewing the contents.

When the blank 11 of FIG. 1 is folded and assembled into its container shape 10, as shown in FIG. 2, the various panels, walls and flaps are arranged as follows. The first end cover flaps 23,24 are folded inside of and secured to the second end cover flaps 25,26 with staples or the like. For this purpose, and because the end cover flaps 23,24 are shown to be long enough to cover the handhole cut outs 35,36, the flaps 23,24 are provided with the cut out areas 33,34 to permit access to the handholes. Similarly, the end walls of the container are formed when the flaps 30,28 and 32, and 29,27 and 31 respectively, are assembled together at each end of the container. The order of assembly is not significant except that flaps 29 and 30 should be arranged on the outside. After the flaps are assembled together, the slots 41,43,45 and 42,44,46 should coincide with one another respectively, and if so, the end flaps can be secured together with staples or the like. These steps produce a container with an integral, hinged top cover 13, front cover 12 and end cover flaps. The end cover flaps 24,26 and 23,25 each include handhole cut outs 35,36 and the end walls 30,28,32 and 29,27,31 each include locking slots for the handhole locking tongues 37,38.

After the container is filled, the hinged cover 13 is closed and secured in position on the container by tucking the handhole locking tongues 37,38 into their respective locking slots. FIG. 3 illustrates the container in its filled and locked condition. Meanwhile, FIG. 4 shows in cross section how the locking tongue 38 is tucked into the locking slot formed by the slots 42,44 and 46 in panels 28,30 and 32 respectively. As shown in FIG. 4, the tongue 38 passes through four thicknesses of the blank material and provides more than adequate strength for the ends of the container and also serves to distribute the load of the container uniformly throughout the end walls. The locking tongues are readily removed from the locking slots simply by lifting the end cover flaps 24,26 and 23,25 away from the ends of the container. Thus, the container is ready for emptying and reuse if desired.

The container of the present invention is highly advantageous since it provides handholes for a hinged cover container having locking tongues associated with the handholes, and a means for retaining the hinged cover on the container when the container is picked up. The handhole locking tongues also provide a reinforcing means for the handholes so that the container can accept a heavy load without overstressing the weaker portions of the container. The integral hinged cover on the container offers protection for the contents and the multiple thickness of the end walls provides good stacking strength.

While a preferred embodiment has been illustrated and described, it is to be understood that the invention should not be limited thereby, since various modifications and changes may be made within the scope of the invention as defined in the appended claims.

I claim:

1. A blank of corrugated paperboard or the like, useful for making a hinged cover container with integral handholes and handhole locks comprising:

(a) a front cover panel, top cover wall, rear wall, bottom wall and front wall connected together in series by separated and parallel fold lines;

(b) a first pair of end cover flaps foldably attached to the ends of said front cover panel;

(c) a second pair of end cover flaps foldably attached to the ends of said top cover wall;

(d) a plurality of end wall flaps foldably attached to the ends of the rear wall, bottom wall and front wall respectively;

(e) a pair of handhole cut outs with integral locking tongues located substantially centrally of each of said second pair of end cover flaps;

(f) a pair of access cut outs located in the ends of said first pair of end cover flaps; and, (g) a plurality of locking tongue receiving slots located in the ends of the end walls connected to said rear wall and front wall and substantially centrally of the end walls connected to said bottom wall.

2. A shipping container formed from a single blank of corrugated paperboard or the like and characterized as having an integral hinged top cover and a handhole locking means for locking the top cover in position, comprising, a rear wall, bottom wall and front wall connected together along spaced parallel fold lines, a top cover wall foldably attached to the top edge of said rear wall, a front cover wall foldably attached to the opposed free edge of said top cover wall, a plurality of end walls foldably attached respectively to the ends of said rear, bottom and front walls and secured together in overlapping relation at each end of said container, a pair of end cover flaps foldably attached respectively to the ends of said top cover wall and said front cover wall and secured together in overlapping relation, the improvement comprising a handhole cut out and locking tongue located substantially centrally of at least one of said pair of end cover flaps at each end of said container and a plurality of cooperating locking slots located contiguously with one another in the end walls at each end of said container for locking the top cover in position on said container.

3. The shipping container of claim 2 wherein the front cover wall and end cover flaps fit over the front wall and end flaps of said container when the top cover wall is closed and the handhole locking tongues are inserted in the locking slots at each end of the container to retain the top cover wall in position.

4. The shipping container of claim 3 wherein the locking tongues at each end of the container are removed from the locking slots by lifting the end cover flaps away from the end flaps of the container.

5. The shipping container of claim 4 wherein at least one of said end cover flaps at each end of said container contains an access cut out for permitting access to the handhole locking tongue located in the adjacent end cover flap.

6. The shipping container of claim 5 wherein the end flaps attached to the front wall and rear wall only partially overlap and the locking slots are located in the ends thereof.

* * * * *